United States Patent [19]

Benoit

[11] Patent Number: 4,850,066

[45] Date of Patent: Jul. 25, 1989

[54] CHILD'S CRIB

[76] Inventor: Roland A. Benoit, 89 S. Main St., Danielson, Conn. 06239

[21] Appl. No.: 189,171

[22] Filed: May 2, 1988

[51] Int. Cl.[4] ..... A47D 7/02

[52] U.S. Cl. ..... 5/100; 5/93 R

[58] Field of Search ..... 5/93 R, 99 R, 99 B, 5/100, 285, 400, 11, 207, 209, 210

[56] References Cited

U.S. PATENT DOCUMENTS

| | | | |
|---|---|---|---|
| 210,123 | 11/1878 | House | 5/210 |
| 2,223,955 | 12/1940 | Greenbaum | 5/93 R |
| 3,045,259 | 7/1962 | Mayer | 5/100 X |
| 3,145,445 | 8/1964 | Hegman | 5/11 X |
| 3,900,907 | 8/1975 | Mulder | 5/93 R X |
| 4,703,524 | 11/1987 | Brunner | 5/93 R |

FOREIGN PATENT DOCUMENTS

| | | | |
|---|---|---|---|
| 119598 | of 1918 | United Kingdom | 5/100 |

*Primary Examiner*—Gary L. Smith
*Assistant Examiner*—Michael J. Milano
*Attorney, Agent, or Firm*—Charles R. Fay

[57] ABSTRACT

A dropside crib comprising a rear wall, two end panels, a dropside, a stabilizer bar, and a mattress support, all quickly and easily assembled without any tool needed. Special dropside guides and a double action device are built in and operate the dropside according to regulations.

The guides not only provide the guiding function but also serve to hold the dropside to the end posts and also to lock the dropside in "up" position. The guide devices include flat, radial locking tabs at the ends of an actuating rod in the top rail of the dropside.

8 Claims, 4 Drawing Sheets

CHILD'S CRIB

BACKGROUND OF THE INVENTION

It is an advantage to the retailer and the user to be able to set up a crib with the least trouble, tools, and printed instructions. The last are sometimes hard to follow especially if the goods are foreign made. This invention is believed to be the simplest construction and easiest set-up from the shipping carton, of any crib in existence, and no tools, not even a screwdriver is necessary. This crib has a dropside and a spring type mattress support of simple but novel constructions, and the drop side cannot be lowered without the double action of the hand manipulation thereof that lends a degree of safety, but these advantages do not add to the complexity of the novel structure but are inherent merely by the simple erection process.

The present crib is conveniently made mostly of wood with a few metal or plastic fittings, and is relatively inexpensive as well as being sturdy and rigid, once set up.

SUMMARY OF THE DISCLOSURE

The present crib comprises two end panels, a front side, a rear side and a mattress support. The front side is slidable up and down on corner posts that are part of the end panels, and the rear side may be fixed relative to the end panels, or of course it could also slide like the front side. The mattress support may be of any usual description except that it has novel connections to the two end panels, these connections being spring pressed into place on the end panels at selected vertical positions. There is also one further member, a stiffener bar that extends between the front side end panel corner posts. Where the rear side is fixed in position, there is no need of such a stiffener at the rear side, but at the front side the dropside is located, it adds to the rigidity and strength of the crib.

The connections of end panels to rear and front sides are semi or better bayonet slots and headed fasteners made so that they rigidify the parts into a rigid rectangular form simply by assemble of the heads in the slots and the placement of the stiffener at the rear aspect of the front side, out of the way and out of casual sight. This stiffener is assembled by headed fasteners also, but it is moved laterally in companion slots that are horizontal, then into vertical slots, because the front and rear sides are assembled first, and the stiffener most easily fits the corner posts in this manner and not by a mere downward motion.

Figure 3:
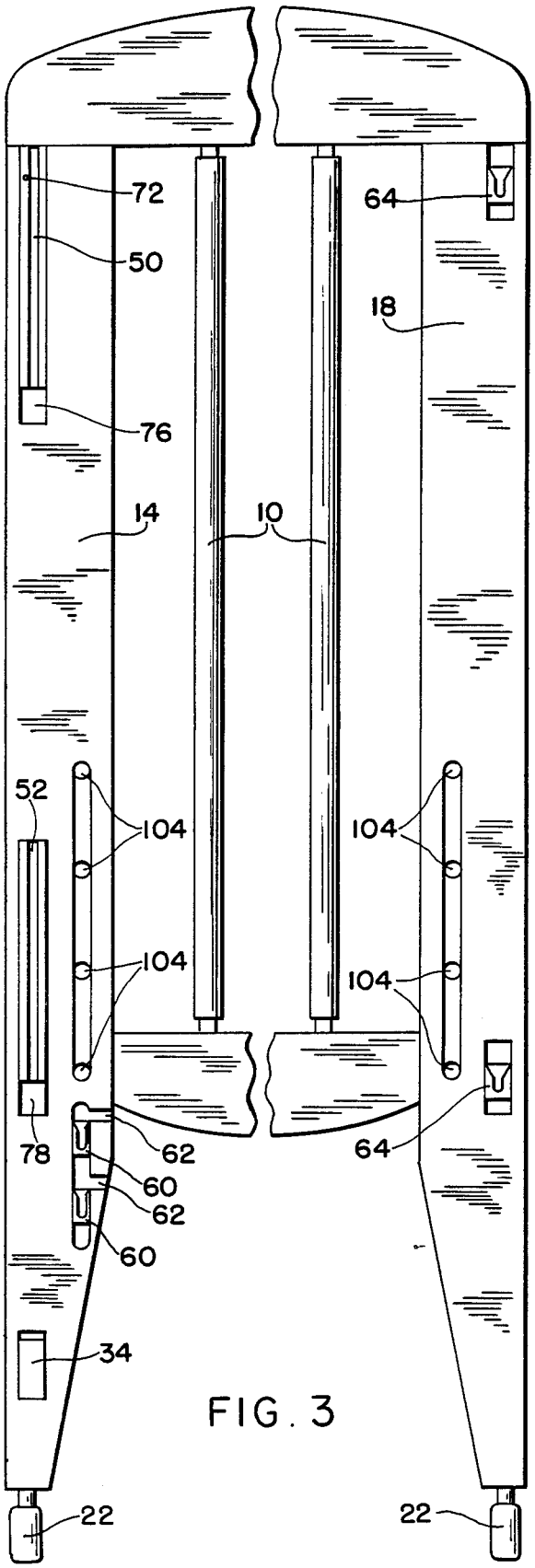
FIG. 3 is an elevational view of the left hand end panel of FIG. 1, parts being broken away.

The right hand panel is a mirror image of FIG. 3.

PREFERRED EMBODIMENTS OF THE INVENTION

Figure 1:
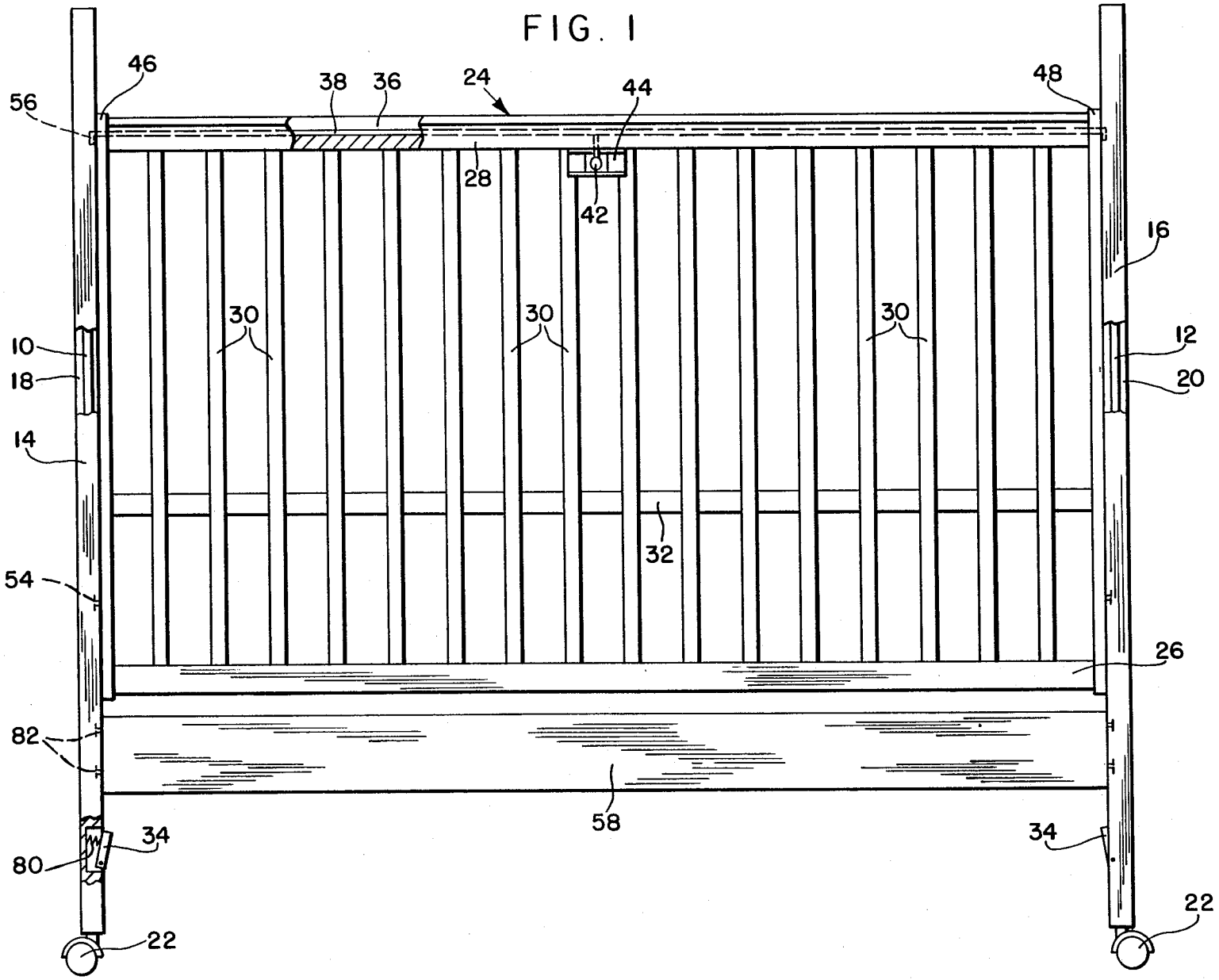
FIG. 1 is a front elevational view of the new crib, part broken away and in sections.
Figure 2:
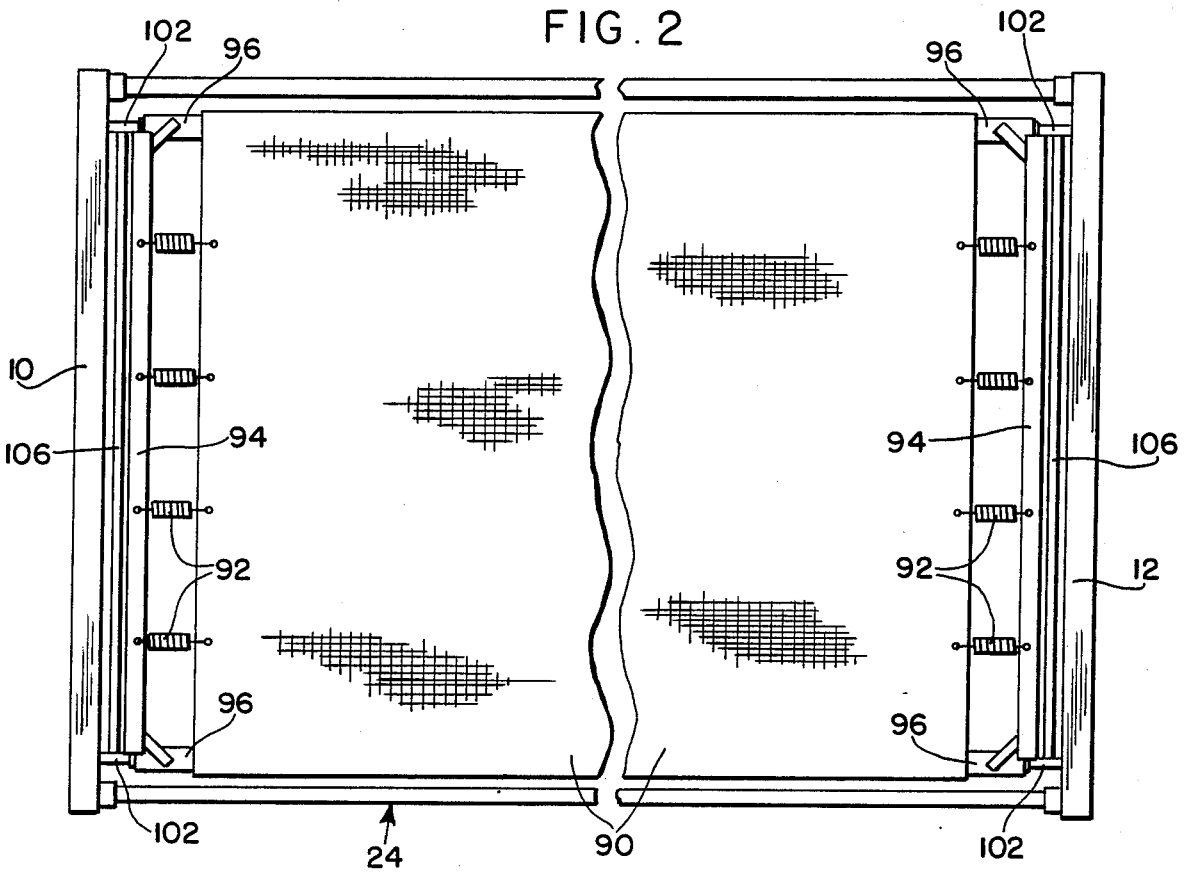
FIG. 2 is a top plan view of the crib.

FIG. 1 shows the front side of the crib which has end panels 10, 12, each end panel having corner posts 14, 16 and 18, 20, and casters or the like 22, 22. There is a rear side not shown in FIG. 1, but of any appropriate general construction, and a front dropside generally indicated at 24. The dropside has a bottom longitudinal rail 26 and a top rail 28, the rails being connected by stiles 30 connected in any convenient way as by dowel (not shown), especially if these parts are wooden. The mattress support is indicated generally at 32 and connected into the corner posts of the end panels, as will appear more fully hereinafter. Spring pressed abutments 34 stop and support the dropside in lowermost position.

The top rail 28 has a longitudinal top groove 36 from end to end and a long rod 38 is located in groove 36, the groove, top of rail 28, and the rod 38 being closed and concealed by a conventional safety rail 40 of the usual construction. At its opposite ends, rod 38 is provided with latches located in the corner posts 14 and 16, and centrally of rod 38 there is an eccentric finger piece 42 for actuating the rod and the latches to release the dropside so it can fall to the abutments 34. A small guard 44 protects this finger piece from accidental actuation from the inside of the crib.

Figure 6:
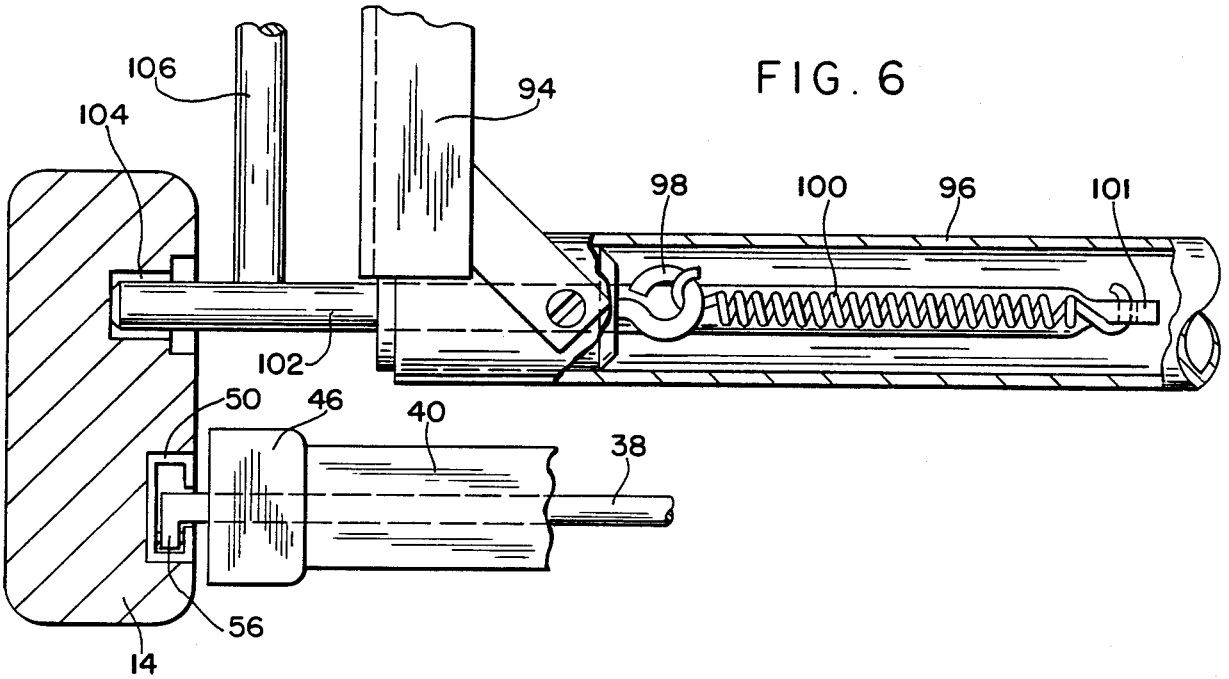
FIG. 6 is an enlarged horizontal section in detail of the mattress supporting element and its connection to an end panel corner post.

To aid in fastening the dropside securely to the front corner posts 14, 16, the dropside has end members 46 and 48 that have flat sides facing the corner posts. The latter also have flat sides, facing inwardly of the crib, see FIG. 3, and inlaid in the corner posts are metal or plastic undercut type tracks as at 50, 52. The vertical end members have T-head screws or pins 54 that ride in tracks 52, holding the lower portion of the dropside to the corner posts, and a rod 38 extends through the member 46, terminating in flat offset radially extending latch tabs 56, FIG. 6, that accomplish the same function in tracks 50. This construction is duplicated at the end of the crib, so that the dropside is easily slid upwardly to the latched position of FIG. 1, from its down position, wherein the bottom rail 26 rests on abutments 34.

Just behind the dropside, in the crib but very close to the dropside there is a stiffening or stabilizer bar 58 that has a pair of spaced T-head fasteners at each end that go into slotted receivers 60 on each of corner posts 14 and 16, FIG. 3, and when forced in slots 62, toward the front of the crib and then down, holds the end panels in fixed relation. When assembling the crib, the rear wall is put on first with the same T-heads fitting in receivers 64, 64. Then the dropside is assembled, tab 56 and T-head 54 being located in the tracks 50, 52. The stabilizer bar has to be assembled last, in order for the dropside to be assembled as described, so it is slid forward and then down, as above described.

Figure 5:
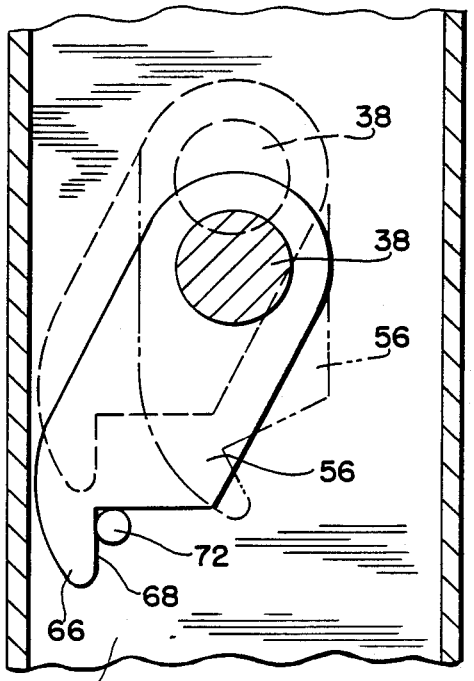
FIG. 5 is a greatly enlarged detail of the dropside lock and illustrating its action.
Figure 4:
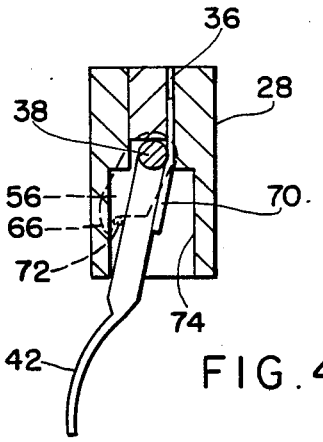
FIG. 4 is a vertical section on an enlarged scale through the top rail of the crib dropside to show the lock therefor and the manual trip for it.

The tab 56 has a break 66 and a notch 68, see FIG. 5, that is normally in the solid line position, held by any kind of spring, such as leaf spring 70 bearing on the finger piece 42 and holding it forwardly, FIG. 4. In this position, when the dropside is pushed up, a small fixed pin 72 is snapped past by the tab 56, the beak 66 acting as a cam. As soon as the beak passes the pin 72, it snaps forwardly and latches the tab 56 over the pin. It will be noted that the tab goes up past its latching position, so that it must be manually raised before pressure on finger piece 42 is able to turn rod 38 enough to clear the pin 72, and let the dropside drop. Thus the "double action" necessary to lower the dropside is accomplished, and accidental lowering of the dropside is averted. It is also to be noted that the tab 56 cannot be moved to a position to release it from the track 50 because the possible motion of the finger piece 42 and rod 38 is very limited in its enclosure at 74, FIG. 4.

In assembling, the rear wall is applied first, by forcing its headed fasteners down into the receivers 64 on the two end panels. This gives a three sided structure open at the front. The dropside is then applied from the bottom, tab hook 56 being entered into track 50 by means of a recess 76 and headed fastener 54 is entered into track 52 through a like recess 78. The dropside can push back the abutments 34 into recesses in corner panels 14 and 16 and the parts are made so that tab 56 and fastener head 54 cannot be removed from the tracks because these members are above the bottoms of tracks 50,52, respectively, when the dropside is stopped on the abutments. These abutments are wedge shaped, pivoted at the lower ends thereof, and projected to a limited degree by any kind of suitable spring as at 80, FIG. 1.

Since the stabilizing bar has headed elements extending from its ends as at 82 in FIG. 1, to be placed in receivers 60, 60, FIG. 3, it cannot then merely be set in from the top, but has to be pulled toward the front through slots 62, and then pushed down. Conversely, the dropside cannot be assembled after the bar 58, so the dropside is assembled after the rear wall, and the stabilizer bar is last.

Figure 7:
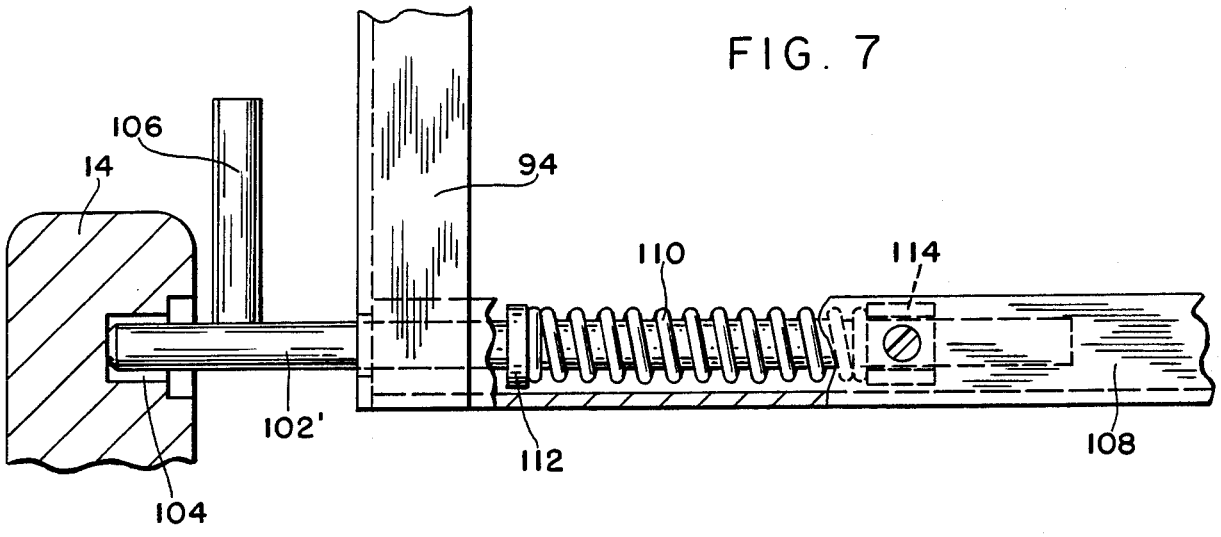
FIG. 7 is a view similar to FIG. 6 but showing a modification.

The crib is complete with these simple actions, but a mattress support must be supplied. The numeral 90 indicates this support and it may be merely a sheet or it may be the well-known chain link type usually used. It has the usual coil springs 92 at its ends that connect to an angle iron 94 at each end and these are connected to side tubes 96, one at each side of the main part 90 of the support. If a sheet 90 is used, it may wrap around these tubes. Near the ends of the tubes they are provided with a fixed inside eye 98 to which one end of a spring or any other suitable elastomeric means 100 is connected, and the other end of each spring is connected to the end 101 of a pin 102 that extends in part out from the end of its tube, and is thus spring pressed outwardly by its spring into a selected recess 104 in a vertical series of such recesses in each corner post. Pins 102, at the sides of the mattress support are connected by a bar 106, so that facing the crib, the operator grasps the two rods 106 and moves these rods and pins 102 toward each other to manipulate the mattress support to enter the pins 102 into desired recesses, the springs 100 maintaining the setting.

Where the usual angle iron 108 is desired to be used for side support instead of tubes, see FIG. 7, a compression spring 110 may be used to service pin 102' by pressing on an abutment 112 on the pin and finding the opposed abutment in member 114 on the angle iron 108, under the horizontal flange and behind the vertical flange of this angle iron.

I claim:

1. A crib comprising a rear wall, two end panels, a front dropside, and a panel to panel stabilizer bar adapted to be assembled without the use of tools, including headed fasteners at the ends of the rear wall and cooperating head receivers on the panels for connection with the heads of the fasteners, dropside latch structure for holding the dropside in an up position, said latch structure including an undercut track on each panel, a rotary latch operating rod, radially extending latch tabs on the ends of the rod, said tabs being located respectively in the undercut tracks, and a headed fastener at each end of the dropside in positions removed from the latch operating rod, and tracks on the panels to receive the heads of the last named fasteners, so that the latch tabs act as guides for the up and down motion of the dropside together with the heads on the headed fasteners on the dropside.

2. The crib of claim 1 wherein the latch structure includes a pin in each of the first name of tracks, and wherein the latch tabs are in the form of hooks that cooperate with the pins to latch the dropside in up position, and means to partially rotate the latch operating rod to free the hook-like tabs from the pins to allow the dropside to drop.

3. The crib of claim 2 wherein the dropside is manually positionable above the latch tab position in which the latch tabs engage the pins to release the latch tabs from their respective pins.

4. The crib of claim 3 including means (tending) to partially rotate the latch operating rod to pin engaging position of the latch tab.

5. The crib of claim 1 including headed fasteners at the end positions of the stabilizer bar and corresponding head receivers on the panels to affix the bar thereto.

6. The crib of claim 5 including tracks in the panels leading to the receivers, the last named tracks being at an angle to the vertical, so that the stabilizer bar may be assembled to the panels after the dropside is assembled.

7. The crib of claim 1 including abutments on the panels to support and stop the descent of the dropside, said abutments being spring pressed outwardly into the path of the dropside or depressed out of the path of the dropside in its downward motion.

8. The crib of claim 4 wherein the pin engaging latch tabs each include a surface facing their respective pins that acts like a cam to press the respective tab back from the respective pin to enable the tabs to clear their pins on the up stroke of the dropside and snap back above the pins to come to rest thereon and automatically latch the dropside in up position.

* * * * *